United States Patent [19]

Price et al.

[11] Patent Number: 4,991,643

[45] Date of Patent: Feb. 12, 1991

[54] HEAT EXCHANGER WITH INTERNAL BYPASS VALVE

[75] Inventors: Stephen G. Price, Corona; James E. Ott, Anaheim, both of Calif.

[73] Assignee: Hayden, Inc., Corona, Calif.

[21] Appl. No.: 398,163

[22] Filed: Aug. 23, 1989

[51] Int. Cl.[5] ..... G05D 15/00; G05D 23/12; F28F 27/02

[52] U.S. Cl. ..... 165/38; 165/34; 165/40; 165/101; 165/103; 165/35; 165/154; 165/916

[58] Field of Search ..... 165/34, 38, 40, 101, 165/103, 916, 35, 154; 137/543

[56] References Cited

U.S. PATENT DOCUMENTS

| | | | |
|---|---|---|---|
| 1,869,637 | 8/1932 | Walworth | 165/103 |
| 2,346,590 | 4/1944 | Rocque et al. | 165/34 |
| 2,619,115 | 11/1952 | Dondero et al. | 137/543 |
| 2,943,845 | 7/1960 | Jakitsch | 165/38 |
| 3,406,745 | 10/1968 | Castelet | 165/101 |
| 3,877,514 | 4/1975 | Beck | 165/103 |
| 3,887,004 | 6/1975 | Beek | 165/184 |
| 4,209,062 | 6/1980 | Woodhull, Jr. | 165/38 |
| 4,633,939 | 1/1987 | Granetzke | 165/154 |

FOREIGN PATENT DOCUMENTS

| | | | |
|---|---|---|---|
| 232309 | 12/1923 | United Kingdom | 165/38 |
| 279446 | 1/1929 | United Kingdom | 165/35 |

*Primary Examiner*—John Ford

*Attorney, Agent, or Firm*—DeLio & Associates

[57] ABSTRACT

A heat exchanger with an internal bypass valve wherein the open end of a bypass tube mounted within a heat exchanger tube forms a valve seat for the bypass valve. A valve head mounted on a valve rod is spring loaded against the valve seat in the preferred design. The length of the contact arms on the valve body controls the valve activation pressure. The heat exchanger tubes may be mounted in parallel and the bypass valves may be mounted in the same direction or in opposite directions to permit bidirectional bypass flow.

15 Claims, 2 Drawing Sheets

HEAT EXCHANGER WITH INTERNAL BYPASS VALVE

Background of the Invention

1. Field of the Invention

This invention generally relates to heat exchangers having an internal bypass valve which may be actuated to bypass the heat exchanger circuit and direct flow into a bypass circuit.

2. Description of related art

Fluid to air heat exchangers of the type commonly used for cooling hydraulic fluid, transmission fluid, oil and other vehicle fluids operate most efficiently when the fluid to be cooled is kept in close contact with the inner surface of the heat exchanger tubes. When the heat exchanger tubes are large in diameter and unobstructed, it is difficult to obtain proper heat transfer between the fluid flowing in the center of the tube and the heat exchanger tube itself.

Furthermore, in such unobstructed tubes, the fluid flow tends to be laminar such that the fluid at the edges of the tube is cooled quickly while the hot fluid in the center of the tube remains in the center of the tube, well away from contact with the tube walls. Because the rate of heat transfer out to the fins on the exterior of the heat exchanger tube relates to the temperature differential between the fluid at the inner edge of the heat exchanger tube and the fins, the cool outer layer of fluid caused by the laminar flow prevents efficient heat transfer.

Accordingly, it is common for heat exchanger tubes of this type to force the fluid to flow near the tube walls by placing an obstruction down the center of the heat exchanger tube which prevents the central flow of hot fluid. It is also known to incorporate some means of turbulating the flow as it passes along the length of the heat exchanger tube thereby constantly bringing fresh hot fluid into contact with the cooler tube walls. However, by restricting the fluid flow to the perimeter region around the inner surface of the heat exchanger tube walls, a large portion of the heat exchanger tube is blocked and its resistance to flow is greatly increased. The flow resistance is also dramatically increased by the turbulation means. As a result, when the working fluid is cold and viscous upon initial vehicle startup, it may be impossible to force the fluid through the perimeter flow region without developing unduly high pressures.

Moreover, when the working fluid is cold and highly viscous, it does not need the cooling provided by the heat exchange circuit described above. Consequently, bypass valves are typically provided to switch the working fluid flow from the heat exchanger circuit to a bypass circuit which is usually less obstructed and has a much lower heat exchanger effectiveness.

Such a bypass valve may be pressure activated, temperature activated or electrically activated responsive to a time, temperature or pressure signal, etc. Originally, such bypass valves were external to the heat exchanger and merely redirected the flow through a bypass tube which completely circumvented the separate heat exchanger. However, this required the installation of a separate external valve outside the heat exchanger system with extra tubing which was expensive to install and prone to leaks and/or damage in harsh operating environments.

Accordingly, modern heat exchangers have been designed to incorporate the bypass valve and bypass circuit inside the heat exchanger. The internal bypass valve opens to provide low restriction, low heat exchanger effectiveness when the working fluid is cold and viscous and closes to redirect fluid flow out of the bypass circuit and into the heat exchange circuit for maximum heat transfer when the fluid is hot and thin.

Although some early heat exchanger designs merely blocked the center of the heat exchanger tubes with a solid core, more recent designs have employed a hollow core formed by a central bypass tube. The bypass circuit formed by the bypass tube may be closed by the bypass valve to maximize heat exchanger efficiency, or may be opened to bypass the heat exchanger circuit. A heat exchanger employing this type of central bypass tube is disclosed in U.S. Pat. No. 3,887,004, issued to Beck on June 3, 1975. Although the central bypass tube may be connected to an external bypass valve, modern designs usually locate the bypass valve within the bypass tube, employing a design which will be referred to herein as a "cartridge" valve design.

A cartridge valve includes a cartridge unit which can be inserted tightly into the bypass tube, such that the outer surface of the cartridge seals against the inner surface of the bypass tube thereby forcing all of the fluid to flow through the cartridge when the bypass valve is open. The cartridge unit may include any type of known valve. Cartridge valve systems of various types, are disclosed in U.S. Pat. No. 3,877,514, issued to Beck on Apr. 15, 1975.

However, cartridge valves have a serious disadvantage in that the cartridge and valve mechanism must be located inside the bypass tube. This inherently causes some undesirable restriction in the flow through the bypass tube.

Accordingly, one of the objects of the present invention is to provide a heat exchanger with an internal bypass valve and a bypass circuit which is less obstructed than previous designs and therefore capable of handling higher flow rates or more viscous fluids. Another object of the invention is to utilize one end of the bypass tube as a valve seat which functions in combination with a valve head to seal the bypass tube. A further object of the invention is to provide a simple means of adjusting the bypass valve actuation pressure during manufacture.

A further object of the invention is to provide a heat exchanger that adjusts its cooling to temperature by proportioning the bypass to the viscosity of the working fluid.

Another object of the invention is to provide a heat exchanger which absorbs flow variations and which prevents flow surges from causing system hammering.

Still another object of the invention is to provide a heat exchanger design which may be made smaller than previous designs and still be capable of handling fluids of the same viscosity and flow rate.

Yet another object of one embodiment of the invention is to provide a multiple valve heat exchanger wherein the valves are redundant and the heat exchanger will continue to operate properly with one or more broken or disabled valves.

Still another object of one embodiment of the invention is to provide a multiple valve and multiple tube heat exchanger which may be installed with either end of the heat exchanger serving as the inlet end.

Still other objects and advantages of the invention will in part be obvious and will in part be apparent from the specification.

Summary of the Invention

The invention comprises a heat exchanger with a novel internal bypass valve design wherein the open end of a bypass tube mounted within a heat exchanger tube forms a valve seat for the bypass valve thereby providing an unobstructed bypass circuit.

A valve head mounted on a valve head guide means is moved by a valve actuation means into and out of sealing contact with the valve seat to open and close the valve.

In a preferred embodiment, the valve actuation means is a spring such that the valve is pressure activated. The spring force may be selected at manufacture to control the valve activation pressure.

The valve includes a valve body with at least one contact arm contacting a stop in a fixed location relative to the valve seat. This arrangement permits the valve body and valve head to be accurately located relative to the valve seat as is required for proper valve operation. The length of the contact arm may be adjusted to control the valve activation pressure.

A plurality of heat exchanger tubes and associated bypass valves may be mounted in parallel to provide increased bypass flow and valve redundancy in case one valve becomes disabled and fails to function.

The valves may have the same or different operating pressures. Alternately, one or more valves may be reversed to accomodate reverse pressures and bidirectional bypass flow. In such a configuration, either end of the heat exchanger may be used as the inlet end.

The invention accordingly comprises the features of construction, combination(s) of elements, and arrangement of parts which will be exemplified in the construction(s hereinafter set forth, and the scope of the invention will be indicated in the claims.

Brief Description of the Drawings

For a fuller understanding of the invention, reference is made to the following description taken in connection with the accompanying drawing(s), in which.

Detailed Description of the Invention

Figure 1:
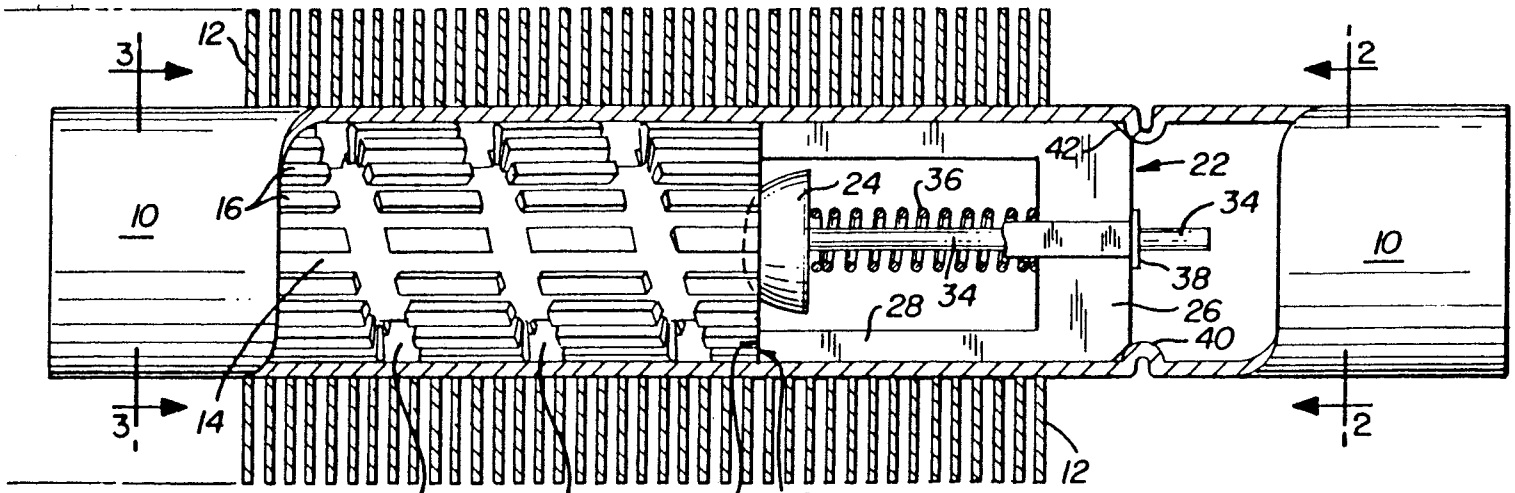
FIG. 1 is a side elevational view partly in section showing a heat exchanger tube and an internal bypass valve according to the present invention.
Figure 4:
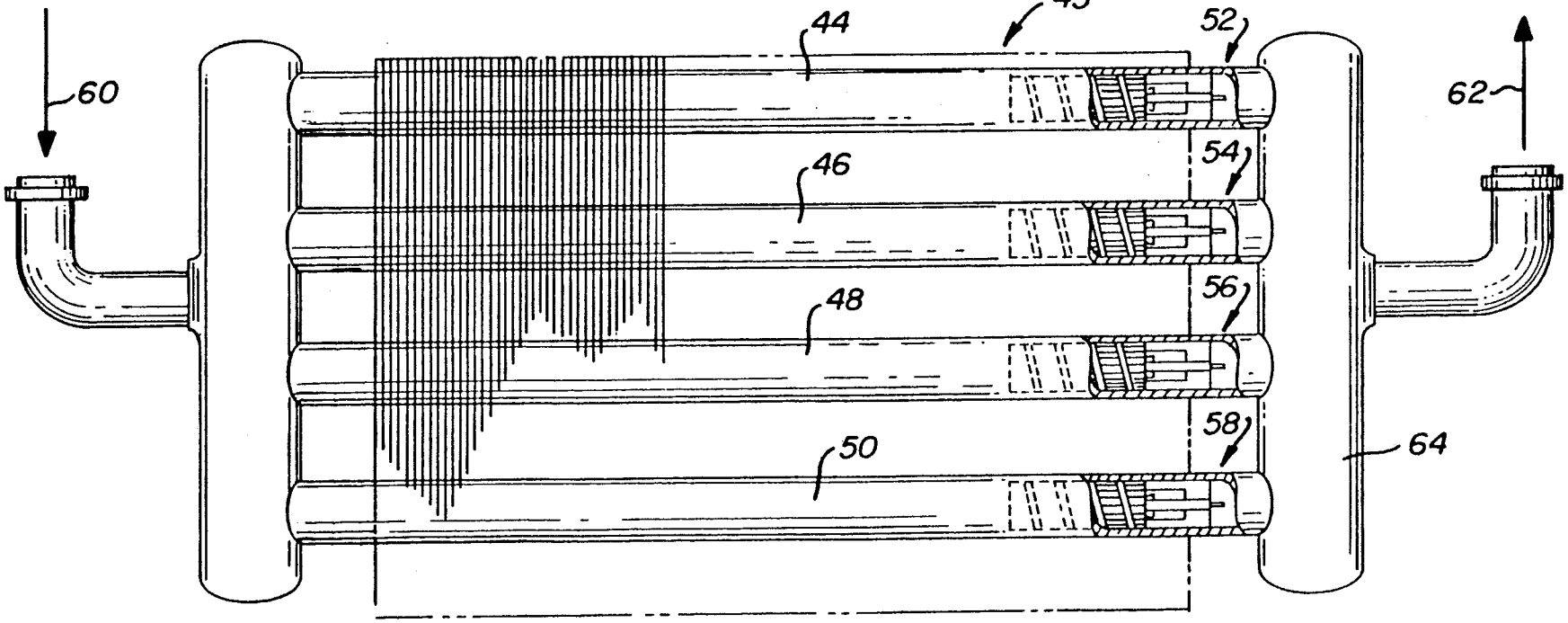
FIG. 4 is a multiple tube heat exchanger with multiple internal bypass valves according to the present invention.

FIG. 1 provides a cross sectional view of a portion of a heat exchanger according to the present invention. The heat exchanger comprises a heat exchanger tube 10 and a plurality of external fins 12 attached in a conventional manner to the heat exchanger tube 10. A complete single tube heat exchanger assembly may be formed by connecting the left and right ends of the heat exchanger tube 10, respectively, as a fluid inlet and outlet, however a more typical installation would include several heat exchanger tubes in parallel connected at both ends to inlet and outlet tubes or headers such as is shown in FIG. 4.

A working fluid to be cooled, such as transmission fluid or oil, is pumped into the left side of FIG. through the interior of the heat exchanger tube 10 towards the right side. Heat is transferred from the working fluid through the walls of the heat exchanger tube 10 to the external fins 12 and from there to a second fluid, typically air, which is forced to flow over the fins. In a vehicle installation, the external fins are usually exposed to the flow of air as the vehicle moves forward. They may also be exposed to a continuous flow of air provided by a fan.

The eternal heat exchanger tube 10 is preferably cylindrical, however, shapes having a non-circular cross section are equally functional. The heat exchanger tube may be manufactured of any suitable heat conducting material including primarily such materials as copper, aluminum, brass, steel, stainless steel and other metals, but also including heat conducting plastics and other tubing materials. In the preferred embodiment, the external heat exchanger tube 10 is aluminum or copper.

Located within the center of the heat exchanger tube 12 is a bypass tube 14. The internal bypass tube is preferably constructed of similar materials to the heat exchanger tube 10, however it is less important for this tube to have good heat transfer properties as it is not necessary for heat to be conducted out of this tube when the bypass circuit is in use.

As previously described, the bypass tube 14 serves to block the central core of the heat exchanger tube 10 thereby forcing the working fluid to flow through the perimeter passageway formed between the outside of the bypass tube and the inside of the heat exchanger tube. This maintains close contact between the working fluid and the inside surface of the heat exchanger tube which promotes rapid and efficient cooling.

A plurality of internal fins 16 are disposed in a generally radial direction around the perimeter of the bypass tube 14. The internal fins 16 perform several important functions. First, they act as a means for securely holding the bypass tube within the heat exchanger tube and preventing longitudinal motion thereof. As is explained more fully below, it is critical to proper operation of the internal bypass valve for the open end of the bypass tube to be immovably located relative to the rest of the bypass valve as this open end forms the valve seat.

Second, the internal fins act as flow turbulators, forcing the working fluid into the turbulent motion which is most effective at rapidly cooling the fluid. Third, the internal fins act as heat conductors which pick up heat from the working fluid and efficiently transfer it through the heat exchanger tube and out to the external fins.

The turbulating function of the internal fins is particularly aided by the spiral slots 18 which cause the working fluid to eddy and swirl instead of flowing smoothly in the passageways formed between adjacent fins.

Figure 3:
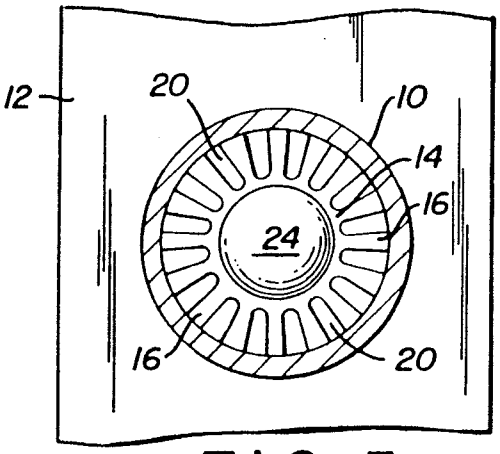
FIG. 3 is a cross sectional view along the line 3—3 in FIG. 1 looking into the inlet end of the heat exchanger tube.

Although the internal fins and bypass tube may be formed as separate components and joined subsequently, in the preferred embodiment they are formed from a single aluminum extrusion into which the spiral slots 18 are machined. FIG. 3 provides a good cross-sectional view of the extrusion which forms both the bypass tube 14 and the internal fins 16

When looking at FIG. 3, one is looking into the heat exchanger tube 10 in the same direction that the working fluid flows. When the fluid is hot, and the heat exchanger is operating in its normal cooling mode, the moving fluid will be confined primarily to the radial passageways 20 formed between adjacent internal fins 16. Fluid flow in the internal bypass tube 14 will be substantially prevented by the closed internal bypass valve generally indicated at 22 in FIG. 1.

As shown in FIG. 1, the internal bypass valve 22 includes a hemispherically shaped valve head 24 which blocks the end of the bypass tube 14 when the valve is closed and the heat exchanger is in the cooling mode.

Figure 2:
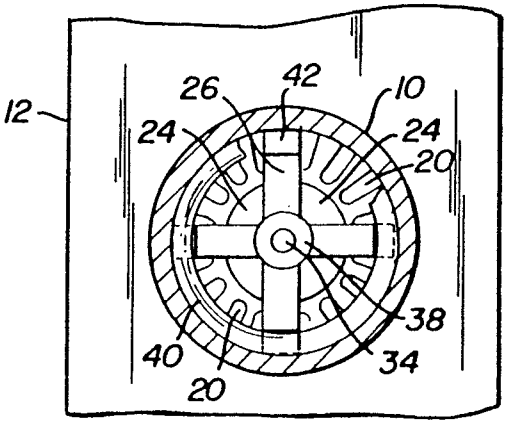
FIG. 2 is a cross sectional view along the line 2—2 in FIG. 1 looking into the outlet end of the heat exchanger tube.

The bypass valve 22 comprises a valve body 26 which has the cross sectional shape of an "X" or a cross as seen in FIG. 2. The space between the arms of the cross permits the working fluid to flow past the valve body 26. At the end of each arm of the cross, and at right angles thereto, is a contact arm 28 which extends parallel to the heat exchanger tube wall. The end of each contact arm 28 forms a stop contact surface 30. During assembly of the heat exchanger, the valve body (which is just slightly smaller than the inside diameter of the heat exchanger tube) is pushed into the heat exchanger tube until the stop contact surface on each contact arm comes into close contact with the face of the extrusion forming a stop 32.

The face of the extrusion is machined flat, thereby causing the stop 32 to be accurately positioned in a fixed location relative to the open end of the bypass tube 14 which forms the valve seat. When the stop contact surface 30 on each contact arm is brought into contact with the stop 30 the valve body is brought into an accurate position relative to the valve seat as is required for proper valve operation.

A valve rod 34 slides through the center of the valve body 26 and is axially aligned with the bypass tube. The valve rod acts as a guide means for the valve head 24 and moves it accurately into and out of sealing contact with the valve seat formed by the open end of the bypass tube.

A spring 36 is located around the valve rod 34 and is compressed between the valve head 24 and the valve body 26. The spring acts as a valve actuation means and holds the valve head against the valve seat, thereby keeping the internal bypass valve closed. The valve seal may be formed to mate with the surface of the valve head when the valve is closed or may be shaped to provide smoother fluid flow when the valve is open.

When the working fluid is cold, the perimeter passageways 20 provide an extreme resistance to fluid flow. This causes a high pressure at the inlet end of those passageways and a low pressure at their outlet end. Accordingly, the pressure on the backside of the valve head 24 is quite low. However, the bypass tube itself contains substantially no restrictions and is connected to the high pressure inlet end of the perimeter passageways 20. Thus, this high pressure is exerted directly on the face of the valve head 24.

This pressure differential is a function of both the flow rate and the viscosity of the working fluid. Increases in either cause the pressure differential to increase. Upon reaching a critical value set by the spring force exerted by spring 36, the valve head 24 and the valve rod 34 slide in a rearward direction against the force of spring 36 opening the bypass valve and permitting fluid flow through the bypass tube. The amount the valve opens is proportional to the pressure differential thereby producing a bypass circuit which bypass proportionally to the extent required.

Although in the embodiment illustrated, the internal bypass valve is pressure activated, the spring 36 may be replaced by some other form of valve actuation means such as a temperature activated bimetallic coil which senses fluid temperature, or by an electrical or mechanical plunger system which operates the valve in response to other parameters.

The illustrated design is particularly suitable for automated assembly and manufacture. The valve rod is held in the valve body by a retainer 38 which holds the spring and valve rod assembly together as a single unit during handling and prior to its insertion into the heat exchanger tube 10. This unit may be separately assembled and stored until needed. Alternatively, the end of valve rod 34 may be stamped and flattened to retain the valve rod in the valve body 26.

It will also be noted that the spring 36 is essentially straight with a single diameter unlike some other valve designs. Thus, the spring 36 to be used in a specific valve may be selected from a set of springs, each spring in the set having a different predetermined spring force. This allows the operating pressure of the internal bypass valve to be selected at the time of manufacture merely by inserting the appropriate spring. The different spring forces may be provided by using springs with different lengths, or the springs may be formed of different diameters of spring steel having different spring constants.

The actual operating force of the bypass valve is set by both the spring constant and the compression of the spring. In addition to adjusting the valve operating pressure by selecting the spring, it may be adjusted by varying the spring compression. This compression is set by the length of the contact arms 28 and, accordingly, the length of these arms may also be adjusted in order to set the desired operating pressure.

In order to accurately obtain the desired predetermined operating pressure for the valve, the position of the valve body must be accurately located relative to the valve seat within only a few thousandths of an inch, i.e. plus or minus about 50 microns.

In order to achieve this accuracy, the stop is positioned in a fixed location relative to the open end of the bypass tube, and the stop contact surface on the valve body is brought into intimate contact therewith. The valve body is permanently held in this position by a roll crimp 40 applied to the exterior of the heat exchanger tube 10. The roll crimp is applied such that the roll crimp protrudes into the interior of the heat exchanger tube and presses firmly against the beveled corners 42 on the valve body 26. Other alternative methods for fastening the valve body are acceptable such as by using adhesives, staking, etc. provided that the valve body is securely fastened in position and the fastening means introduces no leaks and is not loosened by heat, pressure, flow and vibration or other conditions encountered during operation.

Referring now to FIG. 4, a heat exchanger 43 having a plurality of heat exchanger tubes 44–50 can be seen. In the preferred embodiment of the multiple tube design, each heat exchanger tube 44–50 includes an independently actuated internal bypass valve 52–58. Each such valve is substantially as shown in FIG. 1.

Although in some designs it may only be necessary to employ a single bypass valve, the provision of at least two bypass valves provides redundancy in the valve operation such that if one valve becomes disabled and refuses to open, the other valve will continue to provide the required bypass flow. Furthermore, if the first valve refuses to open, the pressure of the fluid on the second valve is increased (as compared to the fluid pressure with the first valve open), causing a corresponding increase in the extent to which the second valve opens. This compensates for the defective valve to an extent which may make it unnecessary for the heat exchanger to be repaired or replaced.

Alternatively, if the first valve sticks in the open position, the second valve will open less far, thereby compensating for this condition as well.

The operating pressures of the four valves in FIG. 4 may be the same or they may be stepped in increments. In the latter case, when the working fluid is cold all of the valves will initially be open. As the fluid warms up and the differential pressure decreases, the valves will close one by one as the differential pressure drops below each valves operating pressure.

It will be noted that because each valve is incorporated entirely within the heat exchanger, it is unnecessary for one installing the heat exchanger to concern himself with external bypass flow fittings and valves. In the design seen in FIG. 4, all four heat exchanger tubes are provided with an internal bypass valve oriented in the same direction. Accordingly, arrows 60 and 62 indicate the inlet and outlet respectively for the working fluid. Due to the common orientation of the valves, proper bypass operation can only be achieved in this configuration.

However, a simple modification of the design shown in FIG. 4 is to end-for-end reverse heat exchanger tubes and their associated bypass valves. In this reversed configuration (not shown), the heat exchanger has no preferred direction, and either end may be used as to the inlet for the working fluid. This greatly simplifies installation as the heat exchanger cannot be installed backwards. The reversed heat exchanger tubes work perfectly well in the heat exchanger mode and the two forward mounted tubes are sufficient when bypass operation is required. Such a four valve reversed design also compensates for sudden backflow pressures by temporarily opening the reverse bypass tubes, as well as providing redundant valve operation in both directions.

Although in the preferred design, the valve is located within the heat exchanger tube, alternative designs are possible wherein the bypass valve is located elsewhere within the heat exchanger, for example within the header 64.

It will thus be seen that the objects set forth above, among those made apparent from the preceding description, are efficiently attained and, since certain changes may be made in the above construction(s) without departing from the spirit and scope of the invention, it is intended that all matter contained in the above description or shown in the accompanying drawing(s) shall be interpreted as illustrative and not in a limiting sense.

In view of the foregoing description it will be apparent that the invention is not limited to the specific details set forth therein for the purposes of illustration, and that various other modifications are equivalent for the stated and illustrative functions without departing from the spirit and scope of the invention.

What is claimed is:

1. A heat exchanger with an internal bypass valve comprising:

a heat exchanger tube;

a bypass insert adapted for fixed mounting within the heat exchanger tube including:

a substantially unobstructed bypass tube having an open end forming a valve seat, a plurality of turbulating internal radial fins in fixed heat conducting contact with the interior of the heat exchanger tube and the exterior of the bypass tube, and a substantially bypass valve adapted to fit completely within the heat exchanger adjacent to the bypass insert including:

a valve body having a diameter equal to the diameter of the bypass insert for insertion into the heat exchanger tube and at least one elongated contact arm extending away from the valve body a predetermined distance, the contact arm being substantially parallel to the heat exchanger tube and having a stop contact surface at an end thereof adapted to contact the stop face formed by the internal fins and the end of the bypass insert, a valve head for sealing against the valve seat and blocking the open end of the bypass tube, a valve head guide means retained by the valve body for guiding the valve head into and out of sealing contact with the valve seat, the valve head being mounted on the valve head guide means, and a valve actuation means for longitudinally moving the valve head and pressing it into sealing contact with the valve seat, the elongated contact arm having a preselected length adapted to function with the valve actuation means to hold the valve body spaced the predetermined distance away from the stop face, said predetermined distance controlling the operation of the bypass valve; and a securement means for holding the stop contact surface on the contact arm in contact with the stop face.

2. A heat exchanger with an internal bypass valve according to claim 1 wherein the bypass valve is pressure activated, the valve head being located at the outlet end of the bypass tube.

3. A heat exchanger with an internal bypass valve according to claim 1 wherein the valve head guide means is a valve rod slidably mounted on the valve body.

4. A heat exchanger with an internal bypass valve according to claim 3 wherein the bypass valve is pressure activated, the valve head being located at the outlet end of the bypass tube, and the valve actuation means comprising a spring.

5. A heat exchanger with an internal bypass valve according to claim 4 wherein the spring is located around the valve rod between the valve body and the valve head.

6. A heat exchanger with an internal bypass valve according to claim 4 wherein the securement means comprises a roll crimp applied to the exterior of the heat exchanger tube, the valve body being mounted within the heat exchanger tube.

7. A heat exchanger with an internal bypass valve according to claim 1 wherein the internal fins are integral with the bypass tube.

8. A heat exchanger with an internal bypass valve according to claim 7 wherein the internal fins and bypass tube are integrally formed from an extruded material.

9. A heat exchanger with an internal bypass valve according to claim 7 wherein the extruded material is aluminum.

10. A heat exchanger with an internal bypass valve according to claim 1 wherein the valve head is hemispherical having a diameter larger than the open end of the bypass tube, the valve head blocking the open end of the bypass tube when the valve is closed and the bypass tube being substantially unobstructed when the valve is open.

11. A heat exchanger according to claim 1 further comprising:

at least one additional heat exchanger tube;

at least two of the heat exchanger tubes having bypass inserts mounted inside, the bypass tube in said bypass inserts having an open end and a bypass valve associated therewith, the open end of the bypass tube forming a valve seat for its respective bypass valve;

a valve body for each bypass valve mounted within the heat exchanger;

a valve head for each bypass valve for sealing against each valve seat;

a valve head guide means for each bypass valve for guiding the valve heat into and out of sealing contact with each valve seat, the valve head being mounted on the valve head guide means; and a valve actuation means for each bypass valve for moving the valve head into and out of sealing contact with each valve seat and thereby independently opening and closing each bypass valve.

12. A multiple tube heat exchanger according to claim 11 wherein the heat exchanger tubes are connected in parallel to each other.

13. A multiple tube heat exchanger according to claim 11 wherein the valve actuation means are springs, and at least two bypass valves have different operating pressures.

14. A multiple tube heat exchanger according to claim 11 wherein at least one bypass valve opens to permit flow in a direction opposite to at least one other bypass valve thereby permitting bidirectional bypass flow through the heat exchanger.

15. A multiple tube heat exchanger according to claim 14 including at least three bypass valves.

* * * * *

UNITED STATES PATENT AND TRADEMARK OFFICE

CERTIFICATE OF CORRECTION

PATENT NO. : 4,991,643

DATED : February 12, 1991

INVENTOR(S) : Price et al.

It is certified that error appears in the above-identified patent and that said Letters Patent is hereby corrected as shown below:

Column 3, Line 32: "accomodate" should read -- accommodate --.

Column 3, Line 38: "construction(s" should read -- construction(s) --.

Column 4, Line 4: "FIG." should read -- FIG.1 --.

Column 5, Line 67: the second occurence of "bypass" should read -- bypasses --.

Column 8, Lines 6-7:

" tube, and
a substantially bypass valve adapted to fit completely"
should read as follows:

-- tube, and
a substantially planar stop face formed by the fins at an end of the bypass insert;
a preassembled bypass valve adapted to fit completely --

Signed and Sealed this

Eighteenth Day of August, 1992

*Attest:*

*Attesting Officer*

DOUGLAS B. COMER

*Acting Commissioner of Patents and Trademarks*